US008272181B2

(12) United States Patent
Tooman et al.

(10) Patent No.: US 8,272,181 B2
(45) Date of Patent: Sep. 25, 2012

(54) GROUT SLEEVE FOR FOUNDATION ANCHOR BOLTS AND METHOD FOR PROTECTION OF ANCHOR BOLTS FOR A VERTICAL STRUCTURE, INCLUDING WIND TURBINES

(76) Inventors: Norman L. Tooman, Bakersfield, CA (US); Joseph W. Bruce, Bakersfield, CA (US)

( * ) Notice: Subject to any disclaimer, the term of this patent is extended or adjusted under 35 U.S.C. 154(b) by 0 days.

(21) Appl. No.: 12/717,084

(22) Filed: Mar. 3, 2010

(65) Prior Publication Data

US 2011/0138720 A1 Jun. 16, 2011

Related U.S. Application Data

(60) Provisional application No. 61/209,135, filed on Mar. 3, 2009.

(51) Int. Cl.

| | |
|---|---|
| ***E02D 27/00*** | (2006.01) |
| ***E02D 27/32*** | (2006.01) |
| ***E04B 1/00*** | (2006.01) |
| ***E04G 21/00*** | (2006.01) |

(52) U.S. Cl. ..... 52/295; 52/296; 52/293.3; 52/741.3; 52/745.17; 416/DIG. 6

(58) Field of Classification Search ..... 52/82, 170, 52/302.5, 701, 295–297, 293.3, 741.3, 745.17; 416/DIG. 6

See application file for complete search history.

(56) References Cited

U.S. PATENT DOCUMENTS

| | | | | |
|---|---|---|---|---|
| 3,500,607 | A * | 3/1970 | Wilson | 52/699 |
| 3,829,540 | A * | 8/1974 | Cox | 264/34 |
| 3,852,931 | A * | 12/1974 | Morse et al. | 52/293.3 |
| 4,117,643 | A * | 10/1978 | Lamothe | 52/699 |
| 4,162,596 | A * | 7/1979 | Damman | 52/295 |
| 5,050,364 | A * | 9/1991 | Johnson et al. | 52/705 |
| 5,174,910 | A * | 12/1992 | Pita | 249/112 |
| 5,553,436 | A * | 9/1996 | Kish et al. | 52/704 |
| 5,586,417 | A * | 12/1996 | Henderson et al. | 52/295 |
| 5,826,387 | A * | 10/1998 | Henderson et al. | 52/295 |
| 6,110,271 | A * | 8/2000 | Skaggs et al. | 106/804 |
| 6,702,522 | B2 * | 3/2004 | Silber | 405/229 |
| 6,837,018 | B1 * | 1/2005 | Hagel et al. | 52/698 |
| 7,155,875 | B2 * | 1/2007 | Henderson | 52/741.15 |
| 7,216,467 | B2 * | 5/2007 | Pott | 52/745.17 |
| 7,520,102 | B1 * | 4/2009 | diGirolamo et al. | 52/741.13 |
| 7,541,089 | B1 * | 6/2009 | Miksic et al. | 428/379 |
| 7,721,494 | B2 * | 5/2010 | Lee | 52/297 |
| 2002/0009622 | A1 * | 1/2002 | Goodson | 428/703 |
| 2002/0056250 | A1 * | 5/2002 | Cash | 52/726.4 |
| 2005/0120665 | A1 * | 6/2005 | Anderson | 52/698 |
| 2009/0044482 | A1 * | 2/2009 | Tooman | 52/699 |
| 2011/0036049 | A1 * | 2/2011 | Oliva et al. | 52/835 |
| 2011/0138720 | A1 * | 6/2011 | Tooman et al. | 52/295 |

* cited by examiner

*Primary Examiner* — Robert Canfield

*Assistant Examiner* — Keith Minter

(74) *Attorney, Agent, or Firm* — James M. Duncan, Esq.; Klein, DeNatale, Goldner, et al.

(57) ABSTRACT

A foundation for a tall vertical structure, such as a wind turbine installation, features anchor bolts having a grout cap slid over the anchor bolt, where the grout cap has a flared skirt which seals against the open annulus formed by the anchor bolt and its accompanying PVC sleeve, where the top of the PVC sleeve is generally flush with the bottom of the grout trough. The grout cap extends from its bottom which abuts the bottom of the grout trough, up and extending at least partially into a bolt hole in the tower flange. A method of protecting anchor bolts utilizing the grout cap is also described.

13 Claims, 8 Drawing Sheets

-PRIOR ART -

- PRIOR ART -

- PRIOR ART -

GROUT SLEEVE FOR FOUNDATION ANCHOR BOLTS AND METHOD FOR PROTECTION OF ANCHOR BOLTS FOR A VERTICAL STRUCTURE, INCLUDING WIND TURBINES

CROSS-REFERENCE TO RELATED APPLICATION

U.S. Provisional Application No. 61/209,135 for this invention was filed on Mar. 3, 2009, for which application these inventors claim domestic priority.

BACKGROUND

This device and method of protection relates to anchoring devices, such as bolts, which are used to install tall, heavy and/or large structures which are subject to high overturning moments. The disclosed device more specifically relates to a grout sleeve for an anchor bolt used in combination with a threaded anchor, and a method for installing the same.

The anchor bolts may either be set in concrete or drilled into the rock. Among other applications, the anchor bolts are used for supporting wind turbines, power line towers, structures used for street lighting and traffic signals, bridge supports, gondola and ski lift support structures, and large signage supports. More particularly, this invention comprises an apparatus, and a method for installing the apparatus, where the apparatus protects the anchor bolts from moisture and corrosive attack caused by water or other liquid entering the annulus formed between the anchor bolt and the anchor bolt sleeve.

The integrity of the foundation of a tall structure is subject to failure if the anchor bolts are not adequately protected. In particular, anchors are subject to corrosive attack caused by the accumulation of water or other electrolytes in the anchoring hole and retained by the anchor bolt sleeve, which can cause a corrosion cell. As described below, the practices employed in preparing the foundation for a wind turbine often create an environment in which the anchor bolt is exposed to water or other liquid.

The initial attempt at solving the anchor bolt corrosion problem was to paint the anchor bolts. However, this solution is labor intensive and does not prevent liquid accumulation around the anchors. In addition, this protection method requires that the anchor bolts be repainted periodically, as well as after re-tensioning the anchor bolts if required in the particular application.

By way of background for wind turbine foundations, U.S. Pat. Nos. 5,586,417 and 5,826,387, both by Henderson, disclose a pier foundation "which can be poured-on-site monolithically and is of cylindrical construction with many post-tensioned anchor bolts which maintain the poured portion of the foundation under heavy compression, even during periods when the foundation may be subject to high overturning moment." Henderson's foundation is preferably in the shape of a cylinder, having an outer boundary shell and an inner boundary shell each formed of corrugated metal pipe.

In the fabrication of one type of foundation for wind turbines, elongated high strength steel bolts, generally fashioned from 1¼" (#10) rebar material or 1⅜" (#11) rebar material, extend vertically up through the concrete from a peripheral anchor plate or ring near the bottom of the cylinder to a peripheral connecting plate or flange at the base of the wind turbine or other structure. The bolts extend through hollow tubes or sleeves to prevent adhesion of the concrete to the bolts. The sleeves are installed prior to delivery of the bolts to the job site, and nuts are generally be placed on each end of the anchor bolt to retain the sleeve on the anchor bolt material.

Henderson further discloses the post-stressing of the concrete in great compression by tightening the nuts on the high strength bolts to provide heavy tension from the heavy top flange (i.e., the flange at the base of the wind turbine) through which the bolts pass to the anchor flange or plate at the bottom of the foundation, thereby placing the entire foundation, between the heavy top plate or flange and lower anchor plate or flange, under high unit compression loading. The nuts on the bolts are tightened so as to preload the bolts to exceed the maximum expected overturning force of the tower structure on the foundation. Therefore the entire foundation withstands various loads with the concrete always in compression and the bolts always in static tension.

The concrete foundation for a turbine tower typically comprises a grout trough which is formed by the placing of a circular template that holds the anchor bolts when pouring the uppermost part of the concrete foundation. Thus, the bottom surface of the grout trough is formed by the top surface of the concrete foundation. The grout trough forms a ring into which high compressive strength grout is poured, where the ends of the anchor bolts extend above the concrete and through the grout poured into the grout trough. Because the tower flange must be set nearly perfectly level, the current practice is to place shims in the grout trough and level the tower flange with laser leveling techniques. Once the shims are leveled, high strength grout is poured into the grout trough and the flange set down on the anchor bolts and the grout allowed to be set up.

Proper alignment of the anchor bolts is important as the anchor bolts must fit within the bolt holes provided in the flange. While there is a slight tolerance for misalignment, in the range of ⅛ to ¼ inches for an individual anchor bolt, the anchor bolts as an anchor bolt package must be nearly perpendicular to the flange and closely matched to ensure a correct and safe tower installation. The ability to align the bolts within the poured and set foundation is helpful to ensure matching the anchor bolts to the bolt holes in the flange.

The anchor bolts may be placed in side-by-side pairs, the pairs extending radially from the center of the foundation, forming an inner ring of bolts and an outer ring of bolts. The bolt pattern is, of course, determined by the bolt pattern on the mounting flange of the structure to be installed on the foundation. A large number of bolts are typically used for this type of foundation. For example, Henderson discloses an embodiment having forty-eight tensioning bolts in the inner ring and forty-eight tensioning bolts in the outer ring for a total of ninety-six. Alternative foundations can utilize more bolts, compounding the problem of anchor bolt alignment with the flange.

In Henderson's foundation, the lower ends of the bolts are anchored at the bottom of the foundation to a lower anchor ring which may be constructed of several circumferentially butted and joined sections. It is to be appreciated that other means may be employed for anchoring the bolts, including drilling a portion of the anchor bolt into the ground.

The bolts usually used for the anchors for wind turbines are approximately thirty feet in length, and usually have outside diameters of 1¼ inch or 1⅜ inch. The hollow tubes or sleeves are typically elongated plastic tubes fabricated from polyvinyl chloride ("PVC") which encase the bolts substantially through the entire vertical extent of the concrete. The room provided by the PVC sleeves allows the bolts to move under the tension generated by applied pressure, and to be tensioned after the concrete has hardened and cured, thereby post-tensioning the entire concrete foundation. The open ends of the PVC sleeves are generally flush with the top surface of the concrete foundation within the grout trough, thus presenting an opening into the annulus between the anchor bolt and the PVC sleeve.

However, the PVC sleeves do not extend along the entire length of the anchor bolts. Specifically, the PVC sleeves do not extend through the peripheral connecting plate or through the bolt holes in the flange at the base of the wind turbine. The hole diameters of flanges used at the base of wind turbines are approximately 1½ inch, and the external diameters of the commonly available PVC sleeves which may be utilized for 1¼ inch to 1⅜ inch diameter bolts are too large to be inserted within the holes in the peripheral connecting plate or flange.

The inability to insert the PVC sleeves into the flange at the base of the wind turbine creates a problem with respect to preventing the flow of water or other liquids down the annulus formed between the anchor bolt and the PVC sleeve. In the known installations, water may flow into and accumulate in the annulus created by the PVC sleeve and the anchor bolt. The accumulation of water or other liquids can result in the formation of a corrosion cell and cause corrosion in the anchor bolts thus affected. Compounding the problem is that it is a common practice to place water within the grout trough prior to pouring the grout to prevent uneven drying of the grout. However, placing the water in the trough causes it to gravitate into the open PVC sleeve ends which are flush with the top surface of the concrete foundation forming the bottom of the grout trough. Prior art methods of sealing the annulus included wrapping a piece of foam material around the bolt and wrapping the foam sleeve with duct tape to retain the sleeve around the anchor bolt, or running a bead of sealant such as caulking compound around the anchor bolt and grout trough juncture. These are labor intensive processes which are not always successful in preventing the flow of water or other fluids into the anchor bolt/PVC sleeve annulus. Additionally, the foam sleeves are extremely compressed and deformed when the heavy tower flange is set down atop the sleeves. The compressed and deformed foam sleeves displace grout, thus diminishing the overall compressive strength of the grout.

SUMMARY OF THE INVENTION

The present application is directed toward a method and apparatus which addresses the problem identified above. The present apparatus comprises a grout sleeve which extends from the base of the grout trough, through the grout layer, and penetrating into the bolt opening on the bottom side the tower flange. The apparatus comprises a sleeve member having a top and a bottom, the sleeve member defining a longitudinal axis, where the internal diameter of the sleeve member may gradually increase from the top to the bottom. The apparatus further comprises a flared skirt which extends outwardly from the exterior of the bottom of the sleeve. An embodiment of the apparatus is configured such that prior to completion of the installation, only the peripheral edge of the bottom of the flared skirt is in facing contact with the bottom of the grout trough. However, once installation has been completed, substantially all of the bottom of the flared skirt is in facing contact with the bottom of the grout trough, thereby forming a seal around the open upwardly facing annulus between the bolt and the bolt sleeve located at the bottom of the grout trough.

DETAILED DESCRIPTION OF THE EMBODIMENTS

Figure 1:
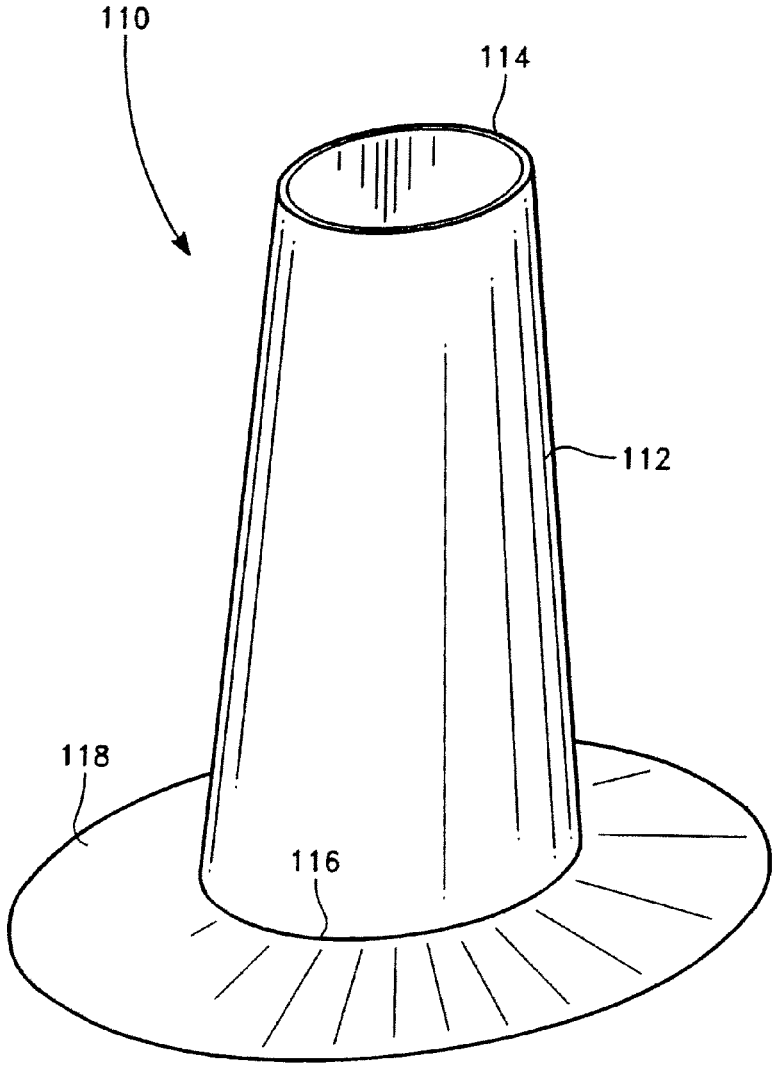
FIG. 1 is a perspective view of an embodiment of the grout sleeve.

Referring now to the drawings, FIG. 1 shows an embodiment of the disclosed grout sleeve 110. The device 110 has a sleeve 112 having an top end 114 and a bottom end 116, wherein the bottom end 116 is connected to a "flared skirt" or skirt 118. Embodiments of the disclosed grout sleeve may be manufactured from polypropylene, polyethylene, rubber or other materials having satisfactory mechanical properties. The term "polypropylene" as used below not only includes polypropylene materials, but other plastic materials having mechanical properties which allow those materials to be substituted for polypropylene.

Figure 3:
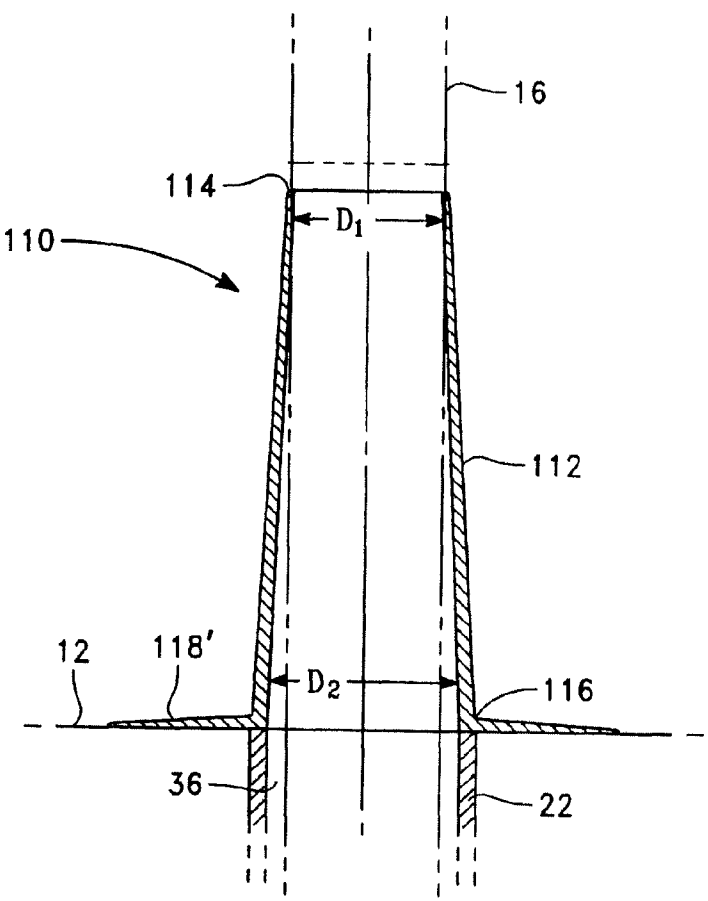
FIG. 3 is a cross sectional view of the embodiment of FIG. 2 following installation.
Figure 2:
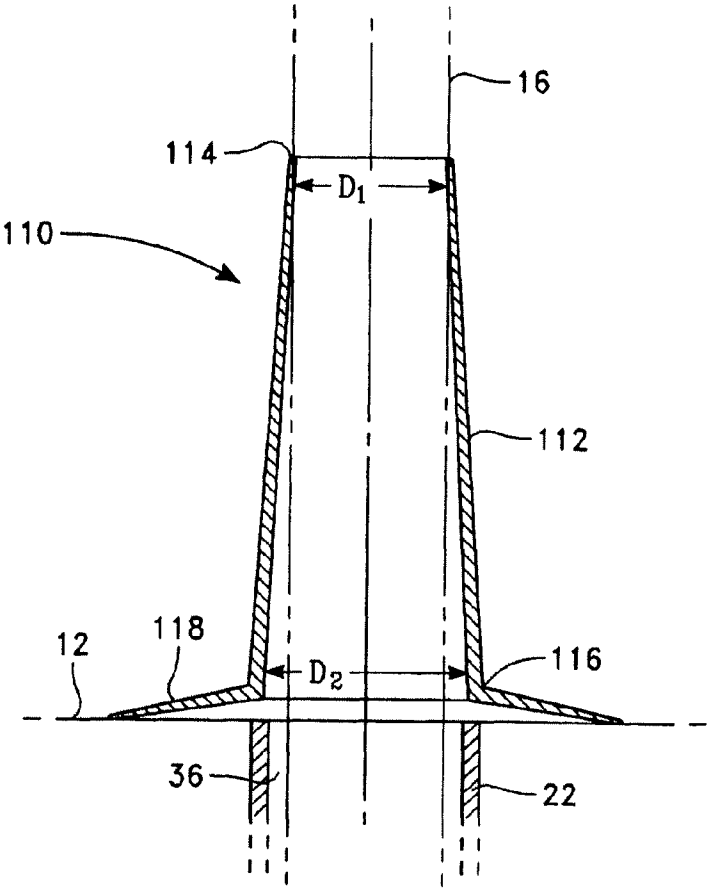
FIG. 2 is a cross sectional view of an embodiment of the apparatus of the disclosed device prior to installation.

Shown in FIGS. 2 and 3 are cross sectional views of an embodiment of a grout sleeve 110 as disposed around an anchor bolt 16. The grout sleeve 110 comprises an top end 114 having a diameter D1 and a bottom end 116 having a diameter D2. An embodiment of the device may be configured such that D1 is less than D2, such that the diameter tapers from the top end to the bottom end, with the diameter increasing along the axis of the grout sleeve. D1 is sized to cause a tight interference fit with the thread of the anchor bolt 16 such that the grout sleeve 110 is installed by pressing the device firmly down the top of anchor bolt 16, causing the top end to stretch to encompass the anchor bolt 16. As shown in FIG. 2, the grout sleeve 110 is fabricated such that skirt or skirt 118 is angled relative to sleeve 112. However upon installation, skirt 118' is compressed such that it is parallel to and in substantial facing contact with the top surface of the foundation 12, which forms the bottom of the grout trough 28. As shown in FIG. 3, skirt 118' provides a beveled surface at the juncture of the skirt 118' and the foundation 12 to assist in providing a liquid tight seal over the annulus 36 formed by the anchor bolt 16 and the PVC sleeve 22. The grout sleeve might include an O-ring or similar gasket underneath the skirt 118 or the installer might place a bead of caulk, silicone gel, or similar sealant either underneath the skirt 118' or encircling the skirt 118'.

Figure 4:
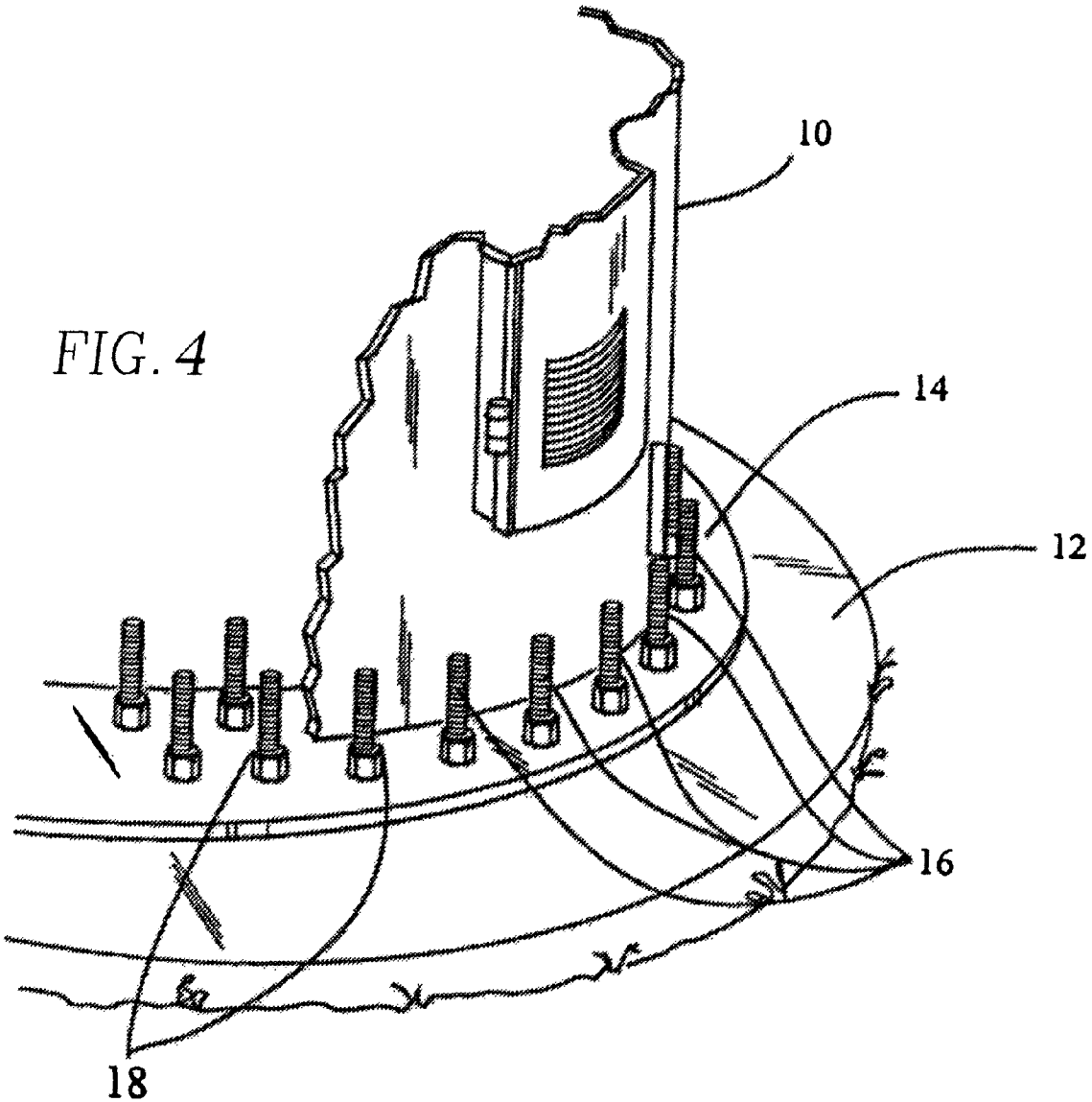
FIG. 4 is a partial perspective view of the base of a tower, such as a wind turbine, showing the bolt configuration.

FIG. 4 shows a partial perspective view of the base of a tower 10, such as a wind turbine. The tower flange 14 is placed atop a foundation 12, and is held in place by nuts 18 threadedly tightened to the anchor bolts 16. The nuts 18 are tightened to provide sufficient prestress to anchor bolts 16 to exceed the maximum expected overturning force of the tower 10 on the foundation 12.

Figure 5:
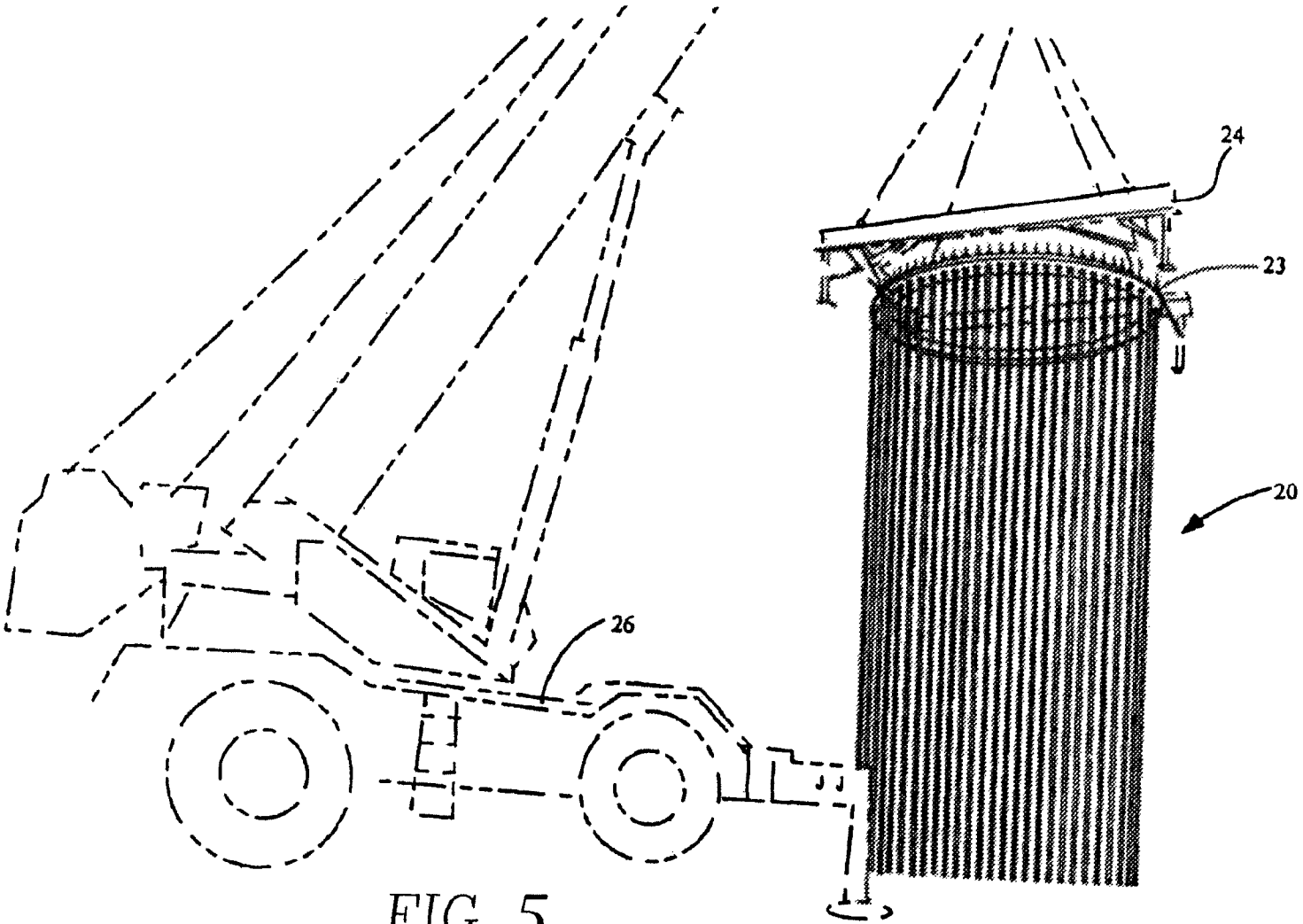
FIG. 5 is a side view of a bolt package being installed into an excavated foundation hole.

Shown in FIG. 5 is an anchor bolt package 20 being installed into an excavated foundation hole. The crane 26 lifts the anchor bolt package 20 by the cradle 24, and lowers the anchor bolt package 20 into the excavation, thereby controlling the placement of the anchor bolt package 20. The grout trough 28 is formed by the circular form 23 holding the anchor bolt package 20 when concrete is poured into the excavation around the anchor bolt package 20, forming foundation 12, comprising a structure of cementitious material. Once the cement has adequately hardened, the bolts may be preloaded, thus placing the structure into compression.

Figure 6:
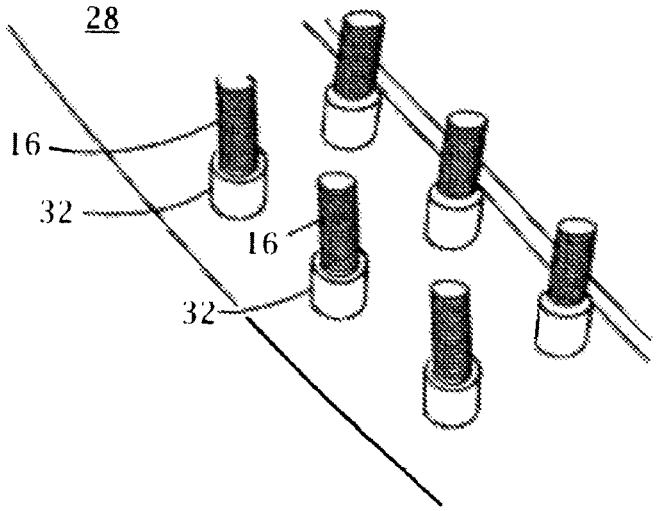
FIG. 6 is a partial view of a grout trough prior to the pouring of the grout, and showing a prior art method for protecting the bolt-sleeve annulus.
Figure 7:
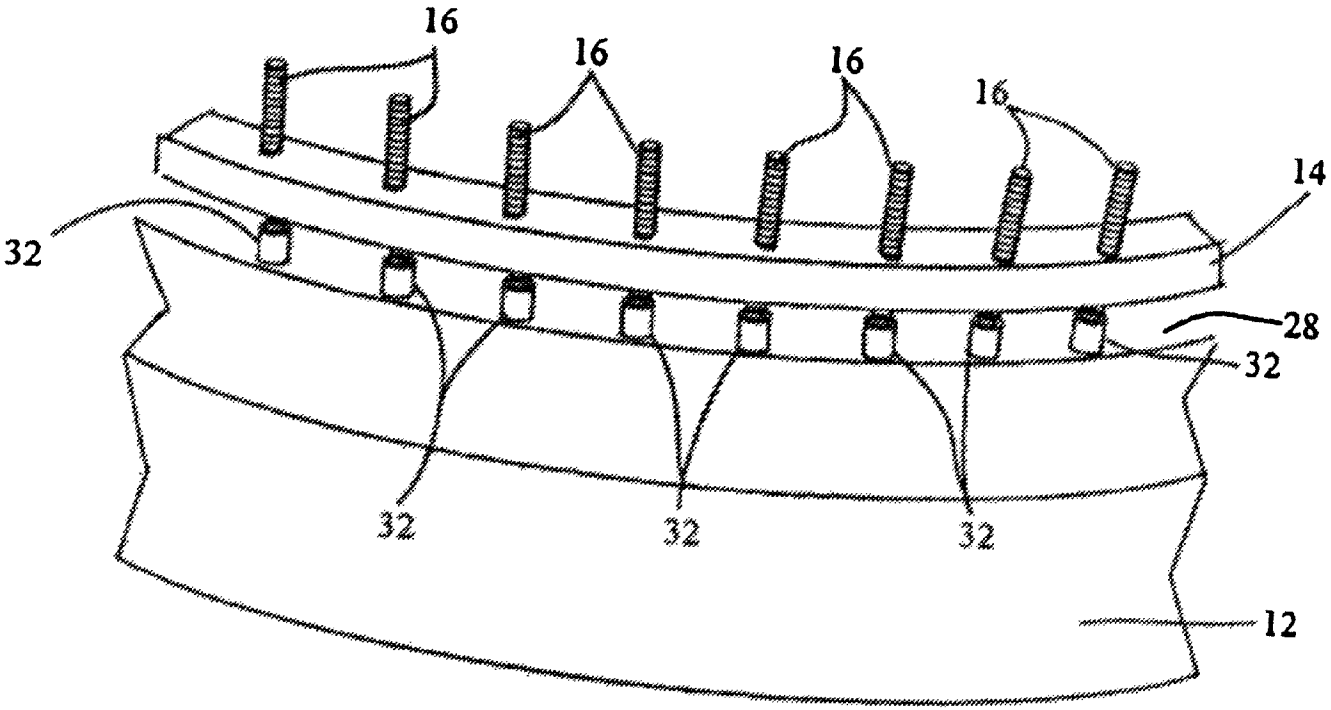
FIG. 7 is a partial perspective view of a tower flange installation prior to the lowering of the tower flange onto the top of the grout trough.

FIGS. 6 and 7 depict a prior art method of attempting to prevent water from accessing the annulus 36 (not shown) between the PVC sleeve 22 and the anchor bolt 16. As shown in FIG. 6, foam sleeves 32, typically having a slit to allow the foam sleeve to form around the anchor bolt 16, are placed around the anchor bolt 16 in an effort to inhibit the flow of liquid down the annulus 36, which is otherwise opened at the bottom of trough 28. Often, duct tape will be wrapped around the foam sleeves 32 in an effort to create a tighter seal. However, preparing and placing the foam sleeves 32 around the anchor bolts 16 is time consuming, resulting in additional expense for labor and equipment. More importantly, it is ineffective in preventing the flow of water into the annulus 36.

FIG. 7 shows a partial perspective view of a tower flange 14 being lowered onto a foundation 12 in the prior art method. As shown, the anchor bolts 16 are wrapped in the foam sleeves 32 prior to and during the pouring or placement of grout into the grout trough 28. It is of great importance that tower flange 14 is installed in a completely level position. Thus, in the known installation method, the tower flange must be leveled before the grout is completely poured and hardens. Following the leveling process, the flange 14 is lowered onto anchor bolts 16, and nuts 18 made up to the required torque to provide the necessary pre-load on the foundation. The foam sleeves 32 will be within the grout in the trough 28 and will be deformed as the flange is lowered into the trough, thus displacing a certain volume of the grout. The risk of cracking or otherwise weakening the grout through compression and the resultant expansion of the foam sleeve 32 is a problem common with the use of the foam sleeves 32 because the expansion of the foam sleeves 32 can be significant. Additionally, the foam sleeve 32 can allow grout to adhere to the anchor bolt 16 and thereby restrict proper setting movement of the anchor bolt 16 during flange 14 placement and preloading of the anchor bolts 16.

Figure 8:
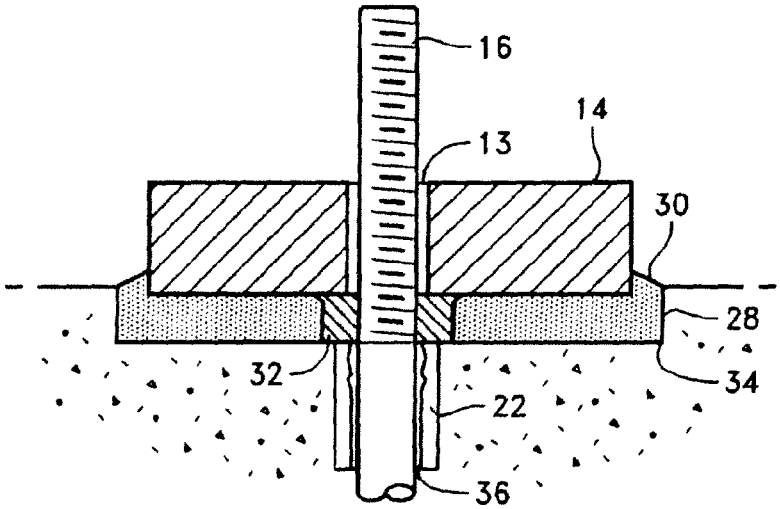
FIG. 8 is a cross sectional view of a prior art method of sealing the annulus following pouring of the grout and placement of the flange.

Shown in FIG. 8 is a cross sectional view of the prior art method of sealing the annulus 36. The foam sleeve 32 is shown in an ideal deformation and it is to be appreciated that the foam sleeve 32 will not always compress evenly or prevent the flow of grout 30 into the annulus 36 formed between the anchor bolt 16 and the PVC sleeve 22. The annulus 36 is not completely sealed by the foam sleeve 32, therefore any water or other liquid placed into the grout trough 28 may enter annulus 36.

Figure 9:
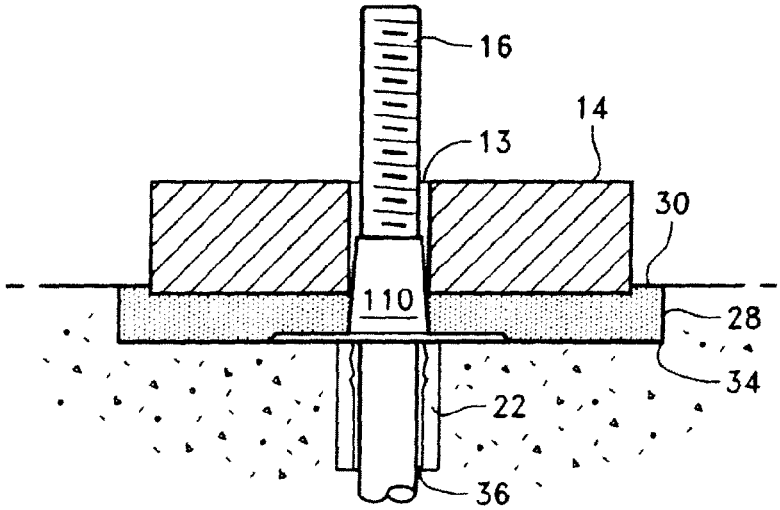
FIG. 9 is a cross sectional view of an embodiment of the disclosed grout sleeve placed between the bottom of the grout trough and extending up into the tower flange.

FIG. 9 shows an embodiment of the presently disclosed grout sleeve 110 as installed. It is to be noted that the top end 114 of the grout sleeve 110 penetrates into the bolt hole 13 in flange 14 with the bottom of skirt 118 disposed against the base of the grout trough formed by top surface 34 of the concrete foundation 12. Thus, skirt 118 thereby forms a seal against annulus 36, thereby inhibiting liquid flow into the annulus. The seal of the skirt 118 against top surface 34 may be enhanced by the utilization of an optional sealant placed underneath or encircling the skirt 118, or an O-ring placed within the bottom surface of the skirt.

Figure 10:
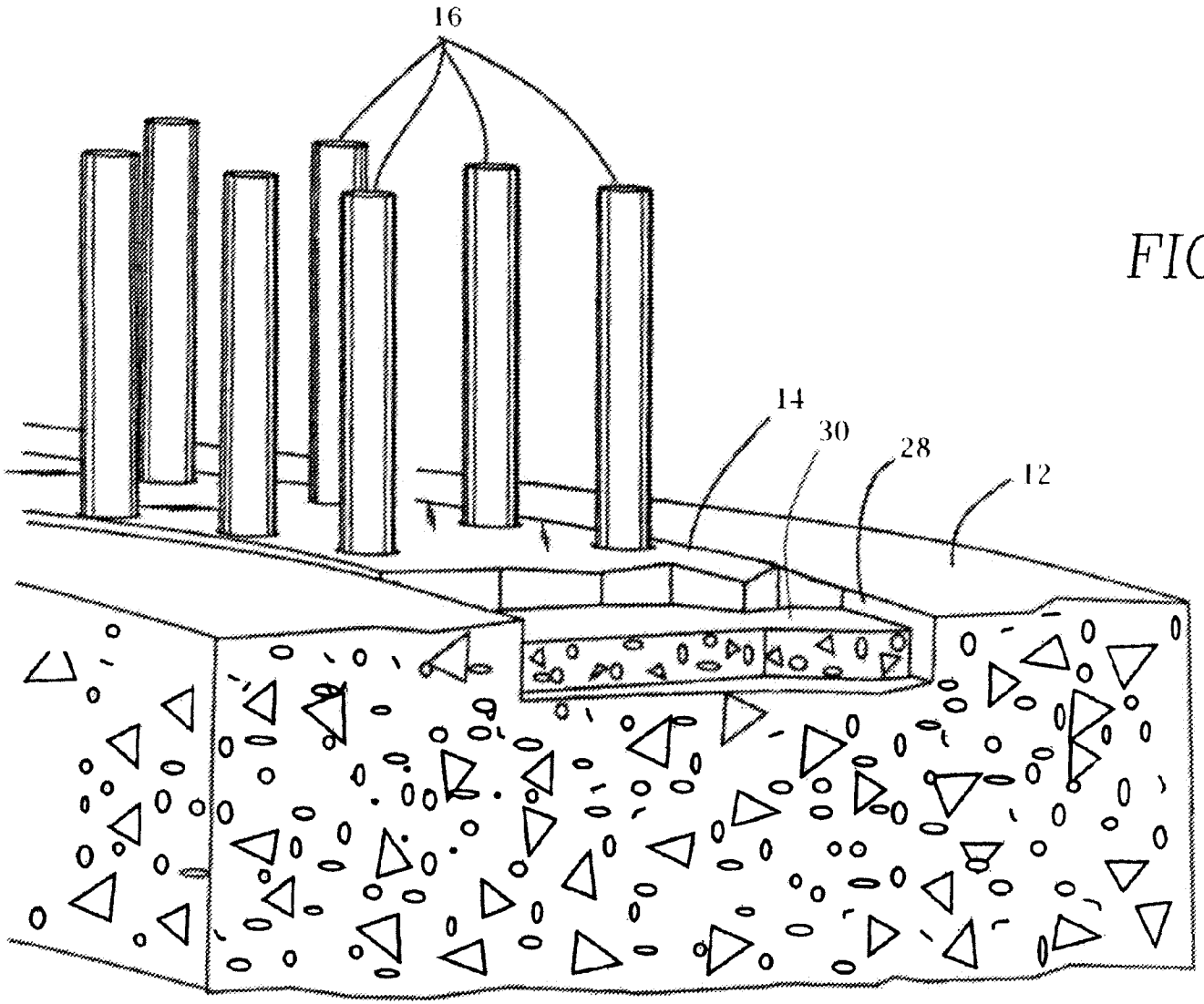
FIG. 10 is a partial perspective view of the cement foundation, anchor bolts, grout trough, grout and flange.

FIG. 10 is a partial perspective view of the cement foundation 12, anchor bolts 16, grout trough 28, grout 30 and flange 14, as installed. The grout 30 (and shims if utilized) provides a level surface for flange 14 on the foundation 12. A low viscosity high strength grout may be utilized, which facilitates the leveling of flange 14 as the grout 30 is essentially self-leveling because of its low viscosity. That is, the grout may be sufficiently self-leveling because of its low viscosity that leveling shims are not required, and the ground may actually be allowed to reach full compressive strength before setting the tower flange upon the top surface of the grout. However, it is to be appreciated that the use of low viscosity grout requires that access into the bolt-sleeve annulus 36 be minimized to prevent corrosion of the anchor bolts 16. The grout sleeve 110 disclosed herein is one means of inhibiting the flow of liquids into the annulus 36.

The method of installing a grout sleeve 110 on an anchor bolt 16 for a vertical structure, including wind turbines, comprises the steps of sliding the grout sleeve with the flared skirt or skirt 118 downwards over a portion of the threaded length of an anchor bolt protruding above the base of the grout trough, and until the bottom of skirt of the grout sleeve is in facing contact with the surface 34 forming the bottom of the grout trough 28, which typically will be the top surface of the concrete forming the foundation 12. The tower flange 14 is lowered over the anchor bolts 16 such that the top end 114 of the grout sleeve 110 penetrates a portion of the bolt hole 13 in flange 14. Tower flange 14 is leveled, and grout 28 placed into the grout trough and allowed to cure.

While the above is a description of various embodiments of the present invention, further modifications may be employed without departing from the spirit and scope of the present invention. Thus the scope of the invention should not be limited according to these factors, but according to the following appended claims.

What is claimed is:

1. In a foundation adapted for installation of a tower flange thereon, said tower flange having a downwardly facing bottom and an upwardly facing top, and a plurality of bolt holes extending from the bottom to the top, the improvement comprising:

a bolt package comprising a plurality of upright, anchor bolts having a lower end anchored in a structure, said anchor bolts having upper ends projecting upwardly from said structure and extending through said tower flange;

each said anchor bolt comprising a sleeve continuously extending along at least a portion of a length of each anchor bolt, but said sleeve terminating at a sleeve top below the downwardly facing bottom of said tower flange, wherein an annulus is defined between the anchor bolt and the sleeve;

said upper ends of said anchor bolts passing upwardly through the tower flange and threaded nuts threaded upon said upper ends above said upwardly facing top of the tower flange and tightened downwardly thereover sufficiently to place said anchor bolts under heavy tension; and the upper end of at least one of said anchor bolts comprising a grout cap disposed over a portion of a length of the at least one anchor bolt, where the portion of the length of the at least one anchor bolt extends from the sleeve top up into the respective bolt hole in the downwardly facing bottom of the tower flange.

2. The foundation of claim 1, wherein the sleeve extending along at least a portion of each anchor bolt is a first sleeve, and further wherein the grout cap comprises a second sleeve having a top end and a bottom end, the second sleeve comprising an opening extending from the top end to the bottom end, the opening sized to slide down over the at least one anchor bolt with an interference fit.

3. The foundation of claim 2 wherein the grout cap further comprises a flared skirt extending peripherally outward from the bottom end, the flare skirt comprising a bottom surface, the bottom surface comprising means for sealing over the first sleeve top and the annulus.

4. The foundation of claim 2 wherein the top end of the grout cap comprises a first inside diameter and the bottom end comprises a second inside diameter, and the first inside diameter is smaller than the second inside diameter.

5. The foundation of claim 1 wherein the grout cap comprises polypropylene.

6. An apparatus for protecting a threaded anchor bolt utilized in the construction of a foundation for a vertical tower, the vertical tower comprising a tower flange having a plurality of bolt holes, the foundation comprising a structure of post-compressed cementitious material extending from an upper end thereof downwardly to a lower end thereof, said foundation comprising a trough for placement of grout and the disposition of the tower flange, wherein said trough comprises a base formed by the upper end of the structure, said structure comprising at least one threaded anchor bolt, said threaded anchor bolt imbedded in and extending through the cementitious material, said threaded anchor bolt comprising a first sleeve continuously extending along the length of the threaded anchor bolt throughout the entire structure, but said first sleeve terminating at a first sleeve top at the base of the trough, said threaded anchor bolt having an upper end projecting upwardly from said upper end of said structure, the apparatus comprising:

a second sleeve having a top end and a bottom end, the second sleeve comprising an opening extending from the top end to the bottom end, the opening sized to slide down over the threaded anchor bolt with an interference fit;

the top end comprising an outside diameter smaller than the diameter of the bolt holes of the tower flange;

a flared skirt extending peripherally outward from the bottom end;

the flared skirt comprising a bottom surface; and the bottom surface comprising means for sealing over the first sleeve top.

7. The apparatus of claim 6 wherein the top end comprises a first inside diameter and the bottom end comprises a second inside diameter, and the first inside diameter is smaller than the second inside diameter.

8. The apparatus of claim 6, wherein the apparatus is fabricated from polypropylene.

9. A method for protecting a threaded anchor bolt utilized in the construction of a foundation for a vertical tower, the vertical tower comprising a tower flange having a plurality of bolt holes, the foundation comprising a structure of post-compressed cementitious material extending from an upper end thereof downwardly to a lower end thereof, said foundation comprising a trough for placement of a mixture comprising grout and the disposition of the tower flange, wherein said trough comprises a base formed by the upper end of the structure, said structure comprising at least one threaded anchor bolt, said threaded anchor bolt imbedded in and extending through the cementitious material, said threaded anchor bolt comprising a first sleeve continuously extending along the length of the threaded anchor bolt throughout the entire structure, but said first sleeve terminating at a first sleeve top at the base of the trough, said threaded anchor bolt having an upper end projecting upwardly from said upper end of said structure, the method comprising the steps of:

sliding a grout cap over a portion of the threaded anchor bolt, the grout cap comprising a second sleeve member, the second sleeve member having a top end, a bottom end, an opening extending from the top end to the bottom end, and a flared skirt extending peripherally outward at the bottom end, the flared skirt comprising a bottom surface, until the bottom surface is in engaging contact with the base and sealing over the first sleeve top;

engaging a bolt hole of the tower flange with the threaded anchor bolt;

lowering the tower flange until the top end of the sleeve member extends into at least a portion of the bolt hole;

leveling the tower flange;

threading a nut up onto the threads of the threaded anchor bolt; and applying sufficient torque to the nut to apply a desired preload to the threaded anchor bolt.

10. The method of claim 9, wherein the mixture of grout comprises a sufficiently low viscosity as to be self-leveling.

11. The method of claim 9 wherein the bottom surface of the flared skirt comprises means for sealing over the first sleeve top.

12. The method of claim 9 wherein the top end of the grout cap comprises a first inside diameter and the bottom end comprises a second inside diameter, and the first inside diameter is smaller than the second inside diameter.

13. The method of claim 9 wherein the grout cap comprises polypropylene.

* * * * *